United States Patent [19]

Newman

[11] Patent Number: 4,869,692

[45] Date of Patent: Sep. 26, 1989

[54] OUTBOARD MARINE PROPULSION SYSTEM INCLUDING A CHAIN DRIVE MECHANISM

[75] Inventor: Neil A. Newman, Omro, Wis.

[73] Assignee: Brunswick Corporation, Skokie, Ill.

[21] Appl. No.: 244,933

[22] Filed: Sep. 15, 1988

[51] Int. Cl.[4] ..... B63H 21/24

[52] U.S. Cl. ..... 440/75

[58] Field of Search ..... 440/49, 75, 78–83, 440/900

[56] References Cited

U.S. PATENT DOCUMENTS

| | | | |
|---|---|---|---|
| 743,700 | 11/1903 | Dupuis | 440/75 |
| 2,345,689 | 4/1944 | Snadecki | 440/75 |
| 2,486,574 | 11/1949 | Roof | 440/75 |
| 2,755,766 | 7/1956 | Wanzer | 440/75 |
| 2,809,605 | 10/1957 | Russell | 440/75 |
| 3,088,430 | 5/1963 | Champney | 440/75 |
| 3,403,655 | 10/1968 | Warburton | 440/75 |
| 3,584,593 | 6/1971 | Blount | 440/75 |
| 3,707,939 | 1/1973 | Berg | 440/75 |
| 3,795,219 | 3/1974 | Peterson | 440/75 |
| 3,922,997 | 12/1975 | Jameson | 440/75 |
| 3,951,096 | 4/1976 | Dunlap | 440/75 |
| 4,382,797 | 5/1983 | Blanchard | 440/75 |
| 4,408,994 | 10/1983 | Blanchard | 440/75 |

FOREIGN PATENT DOCUMENTS

| | | | |
|---|---|---|---|
| 77595 | 4/1986 | Japan | 440/75 |

*Primary Examiner*—Joseph F. Peters, Jr.
*Assistant Examiner*—Jesûs D. Sotelo
*Attorney, Agent, or Firm*—Andrus, Sceales, Starke & Sawall

[57] ABSTRACT

An outboard marine propulsion system incorporates a chain or belt drive for driving the propeller shaft to which the propeller is mounted. The chain extends between the propeller shaft and an intermediate shaft disposed in the upper portion of the depending gearcase of the outboard marine drive. The intermediate shaft is located above the water line during boat operation. A drive mechanism is disposed between the intermediate shaft and a depending drive shaft associated with the engine mounted in the power head of the outboard system. The drive mechanism is preferably located above the water line during boat operation and incorporates a bevel gearing system and a selectively actuable clutch mechanism for providing forward and reverse operation. With the provision of the drive mechanism above the water line during boat operation, the bevel gears associated with the drive mechanism can be sized so as to achieve the large reduction ratio necessary to transfer high power from the power head to the propeller. The increased sizing of the gears has no effect on the frontal area of the submerged portions of the lower unit, thereby having no effect on drag provided by such components during operation.

12 Claims, 1 Drawing Sheet

OUTBOARD MARINE PROPULSION SYSTEM INCLUDING A CHAIN DRIVE MECHANISM

BACKGROUND AND SUMMARY

This invention relates to a marine propulsion system, and more particularly to an outboard marine propulsion system.

In a marine application, it is generally desirable to minimize the frontal area of the submerged drive components in order to reduce drag caused by such components during operation. This presents a difficult problem in high power applications when utilizing a standard perpendicular shaft and bevel gear power transfer arrangement for transferring power from the power head to the propeller. When the proper gear ratio is selected for the optimum propeller in a high power system, the diameter of the bevel gears increases, thereby causing an increase in the transverse dimension of the portion of the gearcase which houses the bevel gears. The resulting increase in gearcase drag certainly detracts from the supposed increase in performance provided by the optimum propeller, and may even result in a decrease in overall performance. That is, the large propeller required for efficiently transferring power through the system requires a gear design furnishing large reduction ratio. Such large reduction ratios are only accomplished by increasing the size of the bevel gears, thereby increasing hydrodynamic drag of the torpedo in which the bevel gears are housed.

If the diameter of the gearcase torpedo is reduced to a more desirable hydrodynamic size, resulting in a reduction in the size of the gears housed therein, then the gear ratio is likewise reduced to the extent that the propeller no longer operates efficiently.

A solution to the above-described problem for a stern drive marine propulsion system is described in copending application Ser. No. 07/244,994 filed 9-15-1988 in the name of Neil A. Newman, and entitled "Stern Drive Marine Propulsion System Including a Chain Drive Mechanism".

The present invention is designed as a solution to the above-noted problems in an outboard application. The invention incorporates an outboard marine propulsion system in which the propeller shaft, disposed in the lower portion of the lower unit, is provided with a sprocket and is driven by a chain. The chain extends between the propeller shaft and an intermediate shaft located above the water line during boat operation. The propeller shaft and the intermediate shaft are substantially parallel, and are oriented so as to be substantially perpendicular to the drive shaft which depends from the power head of the outboard system and is rotatably driven by an engine. A first drive means is disposed between the depending drive shaft and the intermediate shaft for driving the intermdiate shaft in response to rotation of the drive shaft. A second drive means, comprising the above-mentioned chain means, is disposed between the intermediate shaft and the propeller shaft. In a preferred embodiment, the first drive means comprises a bevel gear arrangement for transferring power from the depending drive shaft to the intermediate shaft. A reverse gear and a forward gear are mounted to the depending drive shaft, and are engageable with a bevel gear provided on an end of the intermediate shaft. With the intermediate shaft being located above the water line, the bevel gears transferring power from the drive shaft to the intermediate shaft can be of a relatively large size so as to provide the large reduction ratios required in a high power system while providing no adverse effect on drag of the lower unit caused by the submerged components. A clutch mechanism is mounted to the depending drive shaft for selectively engaging either the forward or reverse gear for imparting rotation to the intermediate shaft in a desired rotational direction. The chain extending between the intermediate shaft and the propeller shaft is preferably housed in a pair of substantially vertical struts formed in the lower unit housing. The struts are preferably spaced from each other so as to provide an air gap therebetween, for reducing the frontal area of the submerged components of the lower unit.

BRIEF DESCRIPTION OF THE DRAWINGS

The drawings illustrate the best mode presently contemplated of carrying out the invention.

In the Drawings.

DESCRIPTION OF THE PREFERRED EMBODIMENT

Figure 1:
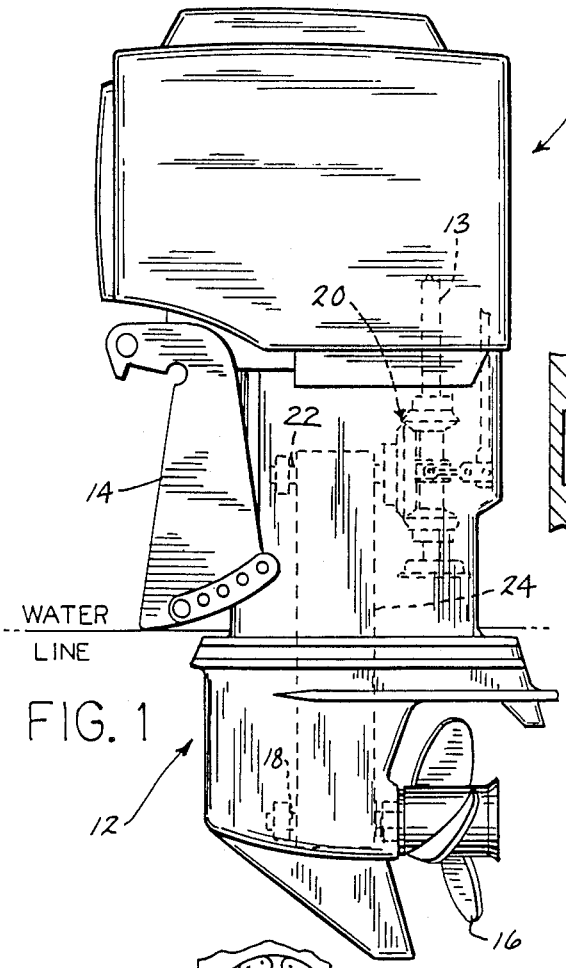
FIG. 1 is an elevation view of an outboard marine propulsion system incorporating the chain drive mechanism of the invention.

With reference to FIG. 1, an outboard marine propulsion system generally includes a power head 10 incorporating an internal combustion engine or the like, and a depending gearcase 12. These components are adapted for mounting to the transom of a boat by means of a mounting bracket 14, as is known.

The engine (not shown) associated with power head 10 includes a depending drive shaft, shown at 13, extending downwardly into the upper portion of depending gearcase 12.

A propeller 16 is mounted to a propeller shaft 18 rotatably mounted in the lower portion of gearcase 12.

Figure 2:
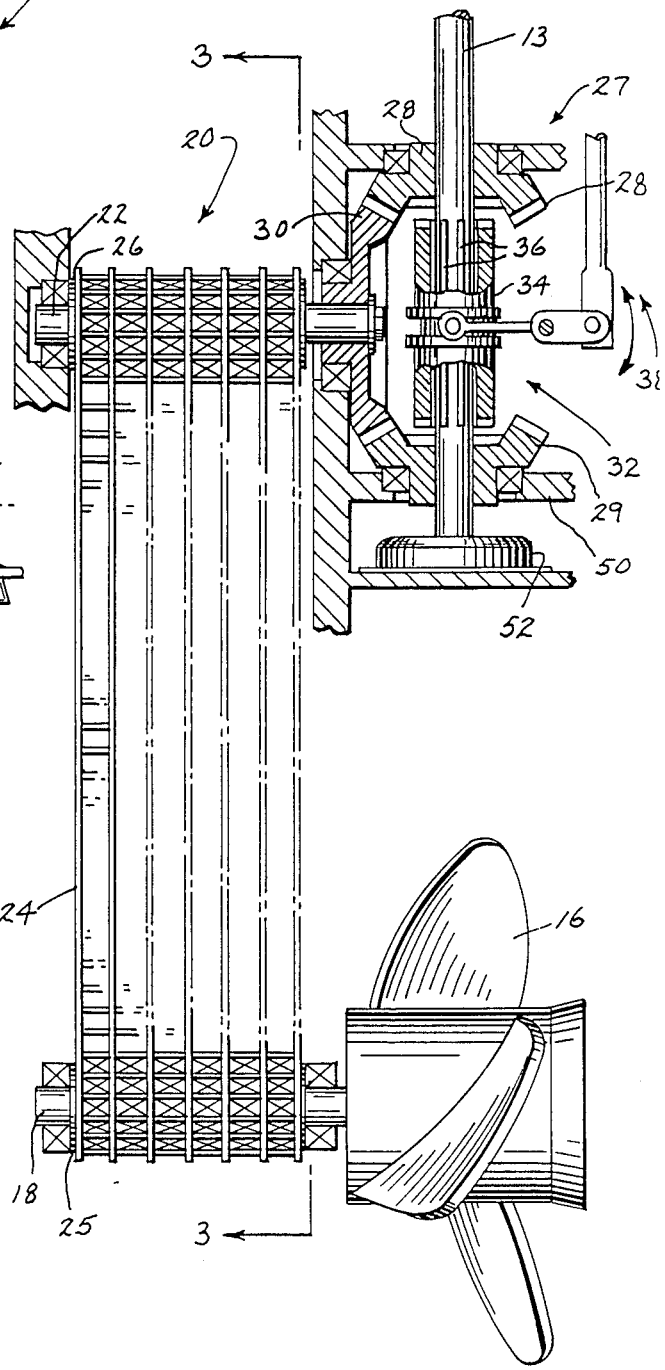
FIG. 2 is a partial elevation view of the internal components of the outboard marine drive system of the invention.

Referring to both FIGS. 1 and 2, a power transfer system 20 is interposed between depending drive shaft 13 and propeller shaft 18 for driving propeller 16 in response to rotation of drive shaft 13. Power transfer system 20 generally includes an intermediate shaft 22 rotatably mounted in the upper portion of depending gearcase 12, with a chain 24 extending between intermediate shaft 22 and propeller shaft 18. Sprockets 25, 26 are mounted to propeller shaft 18 and intermediate shaft 22, respectively, and chain 24 is drivingly engaged with sprockets 25, 26. A drive mechanism, shown generally at 27, is provided for imparting rotation to intermediate shaft 22 in response to rotation of depending drive shaft 13.

It should be understood that, while power transfer system 20 is shown and described as including chain 24 for transferring rotation from intermediate shaft 22 to propeller shaft 18, a notched belt could satisfactorily be employed for performing the same function.

Drive mechanism 27 includes an upper gear 28 and a lower gear 29, both of which are mounted for free rotation about depending drive shaft 13. One of upper and lower gears 28, 29 is adapted to provide forward operation, and the other of such gears is adapted to provide reverse operation. Upper and lower gears 28, 29 are engageable with a driven gear 30 fixed to the rightward end of intermediate shaft 22.

Drive mechanism 27 further includes a clutch mechanism, shown generally at 32, for selectively engaging either upper gear 28 or lower gear 29 for providing forward or reverse operation of power transfer system 20. Clutch mechanism 32 includes a clutch sleeve 34 mounted to depending drive shaft 13 by means of a series of splines, such as shown at 36. Clutch sleeve 34 is thus rotatable in response to rotation of depending drive shaft 13. A shifting linkage 38 is provided for selectively engaging clutch sleeve 34 with either upper gear 28 or lower gear 29. As is known, shifting linkage 38 is operable so as to selectively slide clutch sleeve 34 on drive shaft 13 either upwardly or downwardly, for selectively coupling drive shaft 13 with either upper gear 28 or lower gear 29.

With the above-described arrangement, upper and lower gear 28, 29 and driven gear 30 can be designed to achieve the large reductions necessary for providing an efficient transfer of high power from power head 10 to propeller 16. The size of gears 28, 29 and 30 necessary to achieve such large reductions has no effect on the frontal area of the submerged lower portion of gearcase 12, thereby providing no adverse increased drag which otherwise may result from such increase in gear sizes. The location of gears 28, 29 and 30 above the water line during boat operation insure that such increase in gear size has no effect on lower unit drag.

Figure 3:
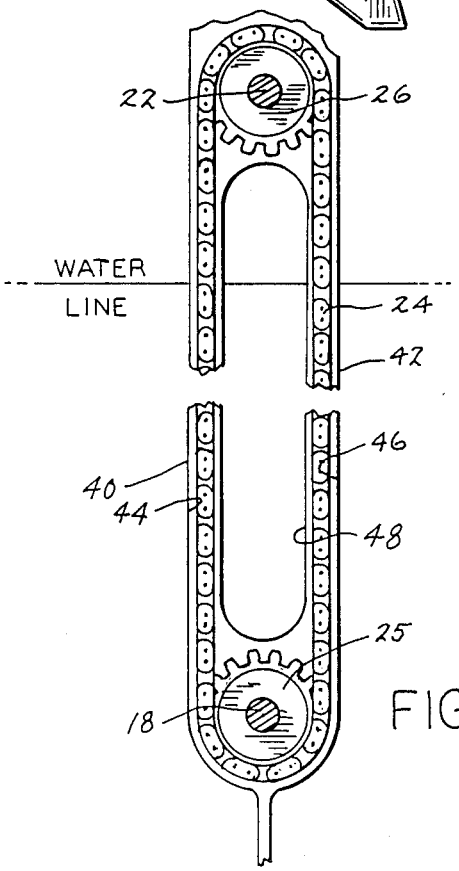
FIG. 3 is a sectional view taken generally on line 3—3 of FIG. 2.

With the provision of chain 24 between intermediate shaft 22 and propeller shaft 18 it is possible to reduce the frontal area of the submerged components of the power transfer system even further. As shown in FIG. 3, the lower portion of the housing of gearcase 12 is formed with a pair of spaced depending struts 40, 42. Struts 40, 42 each include an internal passage 44, 46, respectively, for accommodating passage of the vertical runs of chain 24 as it extends between intermediate shaft 22 and propeller shaft 18. Struts 40, 42 are spaced from each other so as to provide space 48 therebetween, thus eliminating a portion of the frontal area of the lower portion of gearcase 12 which otherwise would be present in a conventional drive system.

Drive shaft 13 extends through a lower wall 50 in which lower gear 29 is rotatably mounted. The portion of drive shaft 13 which projects below wall 50 is interconnectd with a water pump 52 for providing coolant circulation through the cooling system of power head 10, as known. For sea water applications, water pump 52 may be that such as is described in copending patent application Ser. No. 07/241,614 filed 9-8-1988, and entitled "Water Pump for Marine Propulsion System". With this construction, when the engine of power head 10 is running, and rotating drive shaft 13, water pump 52 is constantly circulating fluid through the engine cooling system.

Various alternatives and modifications are contemplated as being within the scope of the following claims particularly pointing out and distinctly claiming the invention.

I claim:

1. An outboard marine propulsion system for a boat comprising:

a power head including a substantially vertical depending drive shaft;

a depending gearcase having a propeller shaft rotatably mounted in the lower portion thereof, said propeller shaft being oriented substantially perpendicular to said drive shaft;

a propeller connected to and rotatable with said propeller shaft;

an intermediate shaft rotatably mounted in the upper portion of said gearcase, said intermediate shaft being oriented substantially perpendicular to said drive shaft and substantially parallel to said propeller shaft;

first drive means disposed between said depending drive shaft and said intermediate shaft for driving said intermediate shaft in response to rotation of said drive shaft, said first drive means being disposed above the water line during operation of the boat; and second drive means disposed between said intermediate shaft and said propeller shaft for driving said propeller shaft in response to rotation of said intermediate shaft, said second drive means extending between and engageable with said intermediate shaft and said propeller shaft.

2. An outboard marine propulsion system for a boat comprising:

a power head including a substantially vertical depending drive shaft;

a depending gearcase having a propeller shaft rotatably mounted in the lower portion thereof, said propeller shaft being oriented substantially perpendicular to said drive shaft;

a propeller connected to and rotatable with said propeller shaft;

an intermediate shaft rotatably mounted in the upper portion of said gearcase, said intermediate shaft being oriented substantially perpendicular to said drive shaft and substantially parallel to said propeller shaft;

first drive means disposed between said depending drive shaft and said intermediate shaft for driving said intermediate shaft in response to rotation of said drive shaft; and second drive means disposed between said intermediate shaft and said propeller shaft for driving said propeller shaft in response to rotation of said intermediate shaft, said second drive means extending between and engageable with said intermediate shaft and said propeller shaft said second drive means comprising chain or belt means engageable with said intermediate shaft, and said propeller shaft for driving said propeller shaft.

3. The outboard marine propulsion system of claim 2, wherein said second drive means comprises driving sprocket means mounted to and rotatable with said intermediate shaft and driven sprocket means mounted to and rotatable with said propeller shaft, said chain means being engageable with said driving and driven sprocket means for transferring rotation of said intermediate shaft to said propeller shaft.

4. The outboard marine propulsion system of claim 2, wherein said gearcase comprises a pair of spaced struts in its lower portion for housing the portions of said chain means extending between said intermediate shaft and said propeller shaft, said struts being separated by a gap so as to reduce the frontal area of the lower portion of said gearcase.

5. An outboard marine propulsion system for a boat comprising:

a power head including a substantially vertical depending drive shaft;

a depending gearcase having a propeller shaft rotatably mounted in the lower portion thereof, said propeller shaft being oriented substantially perpendicular to said drive shaft;

a propeller connected to and rotatable with said propeller shaft;

an intermediate shaft rotatably mounted in the upper portion of said gearcase, said intermediate shaft being oriented substantially perpendicular to said drive shaft and substantially parallel to said propeller shaft;

first drive means disposed between said depending drive shaft and said intermediate shaft for driving said intermediate shaft in response to rotation of said drive shaft;

second drive means disposed between said intermediate shaft and said propeller shaft for driving said propeller shaft in response to rotation of said intermediate shaft, said second drive means extending between and engageable with said intermediate shaft and said propeller shaft; and reversing means for selectively imparting rotation to said propeller shaft in either a first or second rotational direction.

6. The outboard marine propulsion system of claim 5, wherein said reversing means is located above the water line during operation of the boat.

7. The outboard marine propulsion system of claim 6, wherein said reversing means is associated with said first drive means for selectively driving said intermediate shaft in either a first or second rotational direction, thereby selectively driving said propeller shaft through said second drive means in either said first or second rotational direction.

8. The outboard marine propulsion system of claim 7, wherein said first drive means comprises a driving bevel gear mounted to said depending drive shaft and engageable with a driven bevel gear mounted to said intermediate shaft, so that rotation of said drive shaft is transferred to said intermediate shaft through said driving and driven bevel gears.

9. The outboard marine propulsion system of claim 8, wherein said first drive means comprises a forward bevel gear and a reverse bevel gear mounted to said drive shaft and engageable with said driven bevel gear mounted to said intermediate shaft, and wherein said reversing means comprises clutch means for selectively coupling said drive shaft to said intermediate shaft through either said forward or reverse bevel gear for selectively providing rotation of said intermediate shaft in either a first or second rotational direction.

10. The outboard marine propulsion system of claim 9, wherein said forward and reverse gears are mounted for free rotation to said drive shaft and are normally engaged with said driven gear, and wherein said clutch means selectively couples either said forward or reverse gear to said drive shaft for selectively imparting rotation to said intermediate shaft in a desired rotational direction.

11. The outboard marine propulsion system of claim 10, wherein said clutch means comprises a clutch member mounted to and rotatable with said drive shaft, said clutch member being slidably mounted to said drive shaft for selectively engaging either said forward gear or reverse gear.

12. An outboard marine propulsion system for a boat, comprising:

a power head including a substantially vertical depending drive shaft;

a depending gearcase having a propeller shaft rotatably mounted in the lower portion thereof, said propeller shaft being oriented substantially perpendicular to said depending drive shaft;

an intermediate shaft rotatably mounted in the upper portion of said gearcase, said intermediate shaft being disposed above the water line during operation of the boat and oriented substantially perpendicular to said drive shaft and substantially parallel to said propeller shaft;

first drive means disposed between said depending drive shaft and said intermediate shaft for driving said intermediate shaft in response to rotation of said drive shaft, said first drive means being disposed above the water line during operation of the boat, said first drive means comprising cooperating bevel gear means mounted to said depending drive shaft and said intermediate shaft;

reversing means associated with said first drive means for selectively imparting rotation to said intermediate shaft in either a first or second rotational direction in response to rotation of said drive shaft; and second drive means comprising chain or belt means extending between and engageable with said intermediate shaft and said propeller shaft for driving said propeller shaft in response to rotation of said intermediate shaft.

* * * * *